US010751779B2

(12) United States Patent
Fabianek

(10) Patent No.: US 10,751,779 B2
(45) Date of Patent: Aug. 25, 2020

(54) PLATE ROLL BENDING MACHINE BENDING CONTROL SYSTEM AND METHOD

(71) Applicant: Mega Manufacturing, Inc., Rockford, IL (US)

(72) Inventor: Michael Fabianek, Küssnacht (CH)

(73) Assignee: Mega Manufacturing, Inc., Rockford, IL (US)

( * ) Notice: Subject to any disclaimer, the term of this patent is extended or adjusted under 35 U.S.C. 154(b) by 366 days.

(21) Appl. No.: 15/810,310

(22) Filed: Nov. 13, 2017

(65) Prior Publication Data

US 2018/0133772 A1 May 17, 2018

Related U.S. Application Data

(60) Provisional application No. 62/420,874, filed on Nov. 11, 2016.

(51) Int. Cl.

| | |
|---|---|
| ***B21D 5/14*** | (2006.01) |
| ***B21D 43/00*** | (2006.01) |
| ***B21D 5/00*** | (2006.01) |
| *B21D 51/10* | (2006.01) |
| *B21C 37/06* | (2006.01) |

(52) U.S. Cl.

CPC ..... *B21D 5/14* (2013.01); *B21D 5/004* (2013.01); *B21D 43/006* (2013.01); *B21C 37/06* (2013.01); *B21D 51/10* (2013.01)

(58) Field of Classification Search

CPC . B21D 5/12; B21D 5/14; B21D 5/146; B21D 11/203; B21D 5/004; B21B 37/78; B21B 2269/00–2269/08

USPC ..... 72/166, 169–175

See application file for complete search history.

(56) References Cited

U.S. PATENT DOCUMENTS

| | | | | |
|---|---|---|---|---|
| 5,187,959 A * | 2/1993 | Davi | ..... | B21D 5/14 72/10.6 |
| 5,890,386 A | 4/1999 | Davi | | |
| 2013/0233039 A1 * | 9/2013 | Boissin | ..... | B21D 5/14 72/17.3 |

* cited by examiner

*Primary Examiner* — Adam J Eiseman
*Assistant Examiner* — Bobby Yeonjin Kim
(74) *Attorney, Agent, or Firm* — Leydig, Voit & Mayer, Ltd.

(57) ABSTRACT

A hydraulic roll bending machine and method includes loading a plate between top and bottom rollers, receiving a user input indicative of a desired plate radius, calculating a pre-bend radius for the plate based on the desired plate radius and information from the material database, providing a bending signal to the actuator to position the at least one bending roller relative to the top and bottom rollers based on the pre-bend radius, providing a feed signal to advance a leading portion of the plate against the at least one bending roller, determining an actual pre-bend radius of the leading portion of the plate, and calculating an adjustment to the material database based on a difference between the pre-bend radius and the actual pre-bend radius.

20 Claims, 8 Drawing Sheets

| STEP # | STEP DESCRIPTION | WHERE POSITIONS COME FROM | |
|---|---|---|---|
| 1 | START POSITIONS (READY TO FEED PLATE) | PREDETERMINED FROM MACHINE PARAMETERS. A AND C POSITIONED AT A LEVEL LOCATION TO FEED PLATE. B POSITIONED SO THAT PLATE SQUARES AGAINST THE FACE OF THE ROLL. | 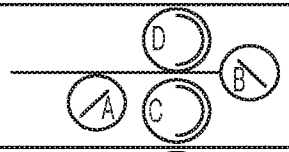 |
| 2 | PLATE CLAMPED BY BOTTOM ROLL | POSITION DETERMINED BY THICKNESS OF PLATE USER INPUT. ROLL C MOVES UP TO CLAMP THE PLATE TO THE TOP ROLL. **(BENDING WIZARD CALCULATES PRESSURE FOR BOTTOM ROLL)** | 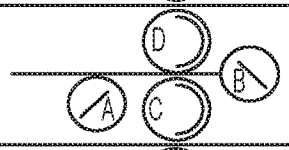 |
| 3 | PLATE IS ROTATED BACK TO CENTERLINE OF TOP AND BOTTOM ROLL | POSITION DETERMINED BY MACHINE PARAMETER PRESET BY DISTANCES FROM FACE OF B ROLL TO CENTERLINE OF D AND C | 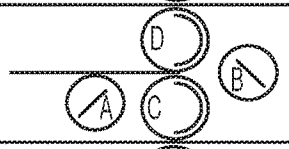 |
| 4 | SQUARING ROLL IS MOVED OUT OF THE WAY | POSITION DETERMINED BY MACHINE PARAMETER PRESET BY A BOTTOM POSITION OF THE ROLL. | 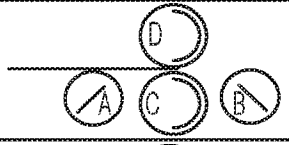 |
| 5 | PREBENDING ROLL POSITION | POSITION DETERMINED BY USER INPUT OF RADIUS DESIRED AND CALCULATIONS BASED ON MACHINE GEOMETRY AND SPRINGBACK CALCULATIONS. **BENDING WIZARD** | 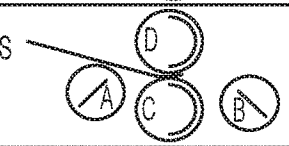 |
| 6 | ROTATE THROUGH THE INITIAL PREBEND | ROTATION DISTANCE DETERMINED BY A MACHINE PARAMETER TO MAKE SURE PLATE IS ROLLED FAR ENOUGH TO REACH ROLL B. | 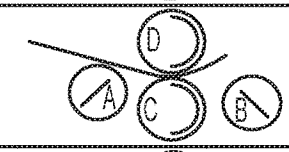 |
| 7 | PREBENDING ROLL IS MOVED OUT OF THE WAY | POSITION DETERMINED BY MACHINE PARAMETER PRESET BY A BOTTOM POSITION OF THE ROLL. | 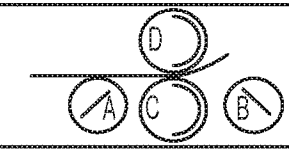 |

TO FIG. 3B

FIG.3A

FROM FIG. 3A

| | | | |
|---|---|---|---|
| 8 | BENDING ROLL POSITION | POSITION DETERMINED BY USER INPUT OF RADIUS DESIRED AND CALCULATIONS BASED ON MACHINE GEOMETRY AND SPRINGBACK CALCULATIONS. **BENDING WIZARD** | 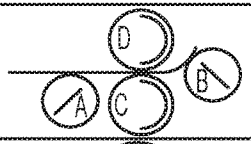 |
| 9 | ROTATE PLATE TO ACHIEVE RADIUS TILL HOLD POINT | ROTATION DISTANCE DETERMINED BY USER INPUT RADIUS MINUS PREBEND ROTATION DISTANCE MINUS FINAL PREBEND DISTANCE SET UP AS A MACHINE PARAMETER. | 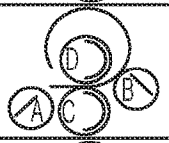 |
| 10 | HOLD | PAUSE THE PROGRAM TO ALLOW OPERATOR TO HOOK ONTO CYLINDER TO COMPLETE ROLLING CYCLE TO THE END OF THE SHEET | 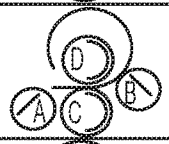 |
| 11 | PREBEND TRAILING EDGE OF SHEET | RAISE THE B ROLL SLIGHTLY TO "OVER-ROLL THE TRAILING EDGE SO THAT IT SPRINGS BACK TO A DESIRED RADIUS. THIS IS A SET DIMENSION APPLIED TO ALL RADII. SUCH AS RAISE AN ADDITIONAL 0.125" | 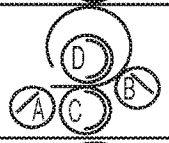 |
| 12 | ROTATE TO END OF PLATE | ROTATE THROUGH THE FINAL PREBEND DISTANCE SET UP AS A MACHINE PARAMETER | 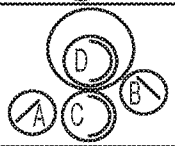 |
| 13 | MOVE B ROLL TO PLATE UNLOAD POSITION | POSITION DETERMINED BY MACHINE PARAMETER PRESET BY LOCATION THAT ALLOWS THE PLATE TO SLIDE OUT OF MACHINE AND CLEAR THE LOW HOUSING | 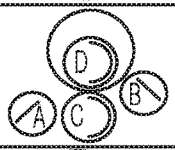 |
| 14 | MOVE A ROLL TO PLATE UNLOAD POSITION | POSITION DETERMINED BY MACHINE PARAMETER PRESET BY LOCATION THAT ALLOWS THE PLATE TO SLIDE OUT OF MACHINE AND CLEAR THE LOW HOUSING | 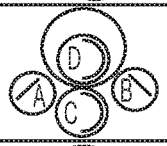 |
| 15 | UNCLAMP THE PLATE FROM THE TOP ROLL | POSITION DETERMINED BY MACHINE PARAMETER PRESET BY BOTTOM POSITION OF C ROLL. | 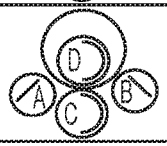 |

FIG.3B

PLATE ROLL BENDING MACHINE BENDING CONTROL SYSTEM AND METHOD

FIELD OF THE DISCLOSURE

The present disclosure generally relates to plate roll bending machines and, more particularly, to plate roll bending machines having hydraulic cylinders.

BACKGROUND OF THE DISCLOSURE

The present disclosure relates to roll bending machines having three or four rolls, which are well known in the metal fabricating industry for rolling metal plate into cylinders, obrounds and cone shapes. This type of machine uses hydraulic cylinders to change the relative position between the various rolls of the machine, and also hydraulic motors to rotate the rolls, such that plates can be formed in any desired shape.

The hydraulic systems of such machines commonly utilize a centrally located hydraulic manifold on which proportional valves, counterbalance valves, solenoid valves, flow control valves, oil pressure sensors and the like are mounted to operate hydraulic cylinders or motors that power and position gripping and bending rolls. In certain machines, the hydraulic manifolds are manufactured to National Fluid Power Association (NFPA) standard dimensions or International Standard Organization (ISO) standard dimensions and can be purchased from catalogs of various manufacturers. Similarly, the cylinders are manufactured to NFPA or ISO standard dimensions and can be purchased from catalogs form various manufacturers.

In a typical roll bending machine, pressurized hydraulic fluid is provided from a hydraulic pump into a manifold, which contains valves and other flow control devices that are fluidly connected, via tubes and hoses, to the various actuators of the machine. The various actuators are selectively activated to advance the plate and position the rolls such that a plate is bent to a desired radius. However, various variables may affect the final shape of the plate, which is typically addressed by experienced operators adjusting the various settings of the machine until a desired plate shape is produced. The variability in the plate shape can result from any number of factors such as the thickness and hardness of the plate, flexing in the bending or gripping rolls of the machine, and others.

In the past, plate roll bending machine manufacturers have attempted to improve the roll process in terms of accuracy in the shape of the bent plate while also minimizing undesirable effects in different ways. One such example can be seen in U.S. Pat. No. 5,890,386 to Davi, which issued on Apr. 6, 1999. Davi describes a roll bending machine in which typical undesirable effects in the bent plate, which are commonly referred to as trumpeting or barreling, are sought to be controlled. These effects, which produce cylinders having their seam either diverging or converging, as shown in FIGS. 5 and 6 of Davi, can result from bending or flexing of the machine rolls during a forming process. In Davi, the rolls are supported by devices (31, FIG. 1 that axially support the bending roll to prevent flexing. While the system configuration of Davi may be partially effective in preventing plate deformation during a bending process due to bending roll flexing, it will not typically account for other factors affecting plate rolling and may partially contribute to achieving a desired bent plate diameter. Moreover, the support members may adversely affect the finish of the rolled plate, especially along an area of contact on the outer surface.

BRIEF SUMMARY OF THE DISCLOSURE

The present disclosure relates to a plate roll bending machine that automatically performs a pre-bending operation, in which various physical properties of the material of the plate can be determined, and then performs one or more finishing bending operations, which take into account the physical properties of the material that were determined during the pre-bending operation, to provide a finished roll at a desired dimension.

In one aspect, the disclosure describes a hydraulic roll bending machine having a top roller, a bottom roller and at least one bending roller. The hydraulic roll bending machine further includes an electronic controller, which includes a material database stored in non-volatile memory, the material database including a material information library of material properties for a plurality of materials. An actuator is associated with the at least one bending roller and operates in response to a bending signal provided by the electronic controller. A motor is coupled with one of the top or bottom roller and operates in response to a feed signal provided by the electronic controller. A position sensor is disposed to measure a position of the at least one bending roller relative to the machine and configured to provide a position signal to the electronic controller.

In one embodiment, the electronic controller is programmed and configured to load a plate between the top roller and the bottom roller; receive a user input indicative of a desired plate radius from a machine user; calculate a pre-bend radius for the plate based on the desired plate radius and information from the material database; provide a bending signal to the actuator to position the at least one bending roller relative to the top and bottom rollers based on the pre-bend radius; provide a feed signal to advance a leading portion of the plate against the at least one bending roller; determine an actual pre-bend radius of the leading portion of the plate; and calculate an adjustment to the material database based on a difference between the pre-bend radius and the actual pre-bend radius.

In another aspect, the disclosure describes a method for operating a hydraulic roll bending machine having a top roller, a bottom roller and at least one bending roller. The method includes using an electronic controller associated with the hydraulic roll bending machine, the electronic controller including a material database stored in non-volatile memory, the material database including a material information library of material properties for a plurality of materials. The method further includes providing an actuator associated with the at least one bending roller, the actuator operating in response to a bending signal provided by the electronic controller; providing a motor coupled with one of the top or bottom roller, the motor operating in response to a feed signal provided by the electronic controller; and providing a position sensor disposed to measure a position of the at least one bending roller relative to the machine, the position sensor configured to provide a position signal to the electronic controller.

In one embodiment, the method includes loading a plate between the top roller and the bottom roller; receiving a user input indicative of a desired plate radius from a machine user into the electronic controller; calculating a pre-bend radius for the plate based on the desired plate radius and information from the material database using the electronic controller; providing a bending signal to the actuator to position the at least one bending roller relative to the top and bottom rollers based on the pre-bend radius using the electronic controller; providing a feed signal to advance a leading portion of the plate against the at least one bending roller using the electronic controller; determining an actual pre-bend radius of the leading portion of the plate, and providing the actual pre-bend radius to the electronic controller; and calculating an adjustment to the material database based on a difference between the pre-bend radius and the actual pre-bend radius using the electronic controller.

In yet another aspect, the disclosure describes an electronic controller associated with a hydraulic roll bending machine, the hydraulic roll bending machine having a top roller, a bottom roller, at least one bending roller, an actuator associated with the at least one bending roller, a motor coupled with one of the top or bottom roller, and a position sensor disposed to measure a position of the at least one bending roller relative to the machine. The electronic controller includes a material database stored in non-volatile memory, the material database including a material information library of material properties for a plurality of materials; a connection to the actuator, which actuator configured to operate in response to a bending signal provided by the electronic controller; a connection to the motor, the motor configured to operate in response to a feed signal provided by the electronic controller; and a connection to the position sensor, the position sensor configured to provide a position signal to the electronic controller.

In one embodiment, the electronic controller is programmed and configured to load a plate between the top roller and the bottom roller; receive a user input indicative of a desired plate radius from a machine user; calculate a pre-bend radius for the plate based on the desired plate radius and information from the material database; provide a bending signal to the actuator to position the at least one bending roller relative to the top and bottom rollers based on the pre-bend radius; provide a feed signal to advance a leading portion of the plate against the at least one bending roller; determine an actual pre-bend radius of the leading portion of the plate; and calculate an adjustment to the material database based on a difference between the pre-bend radius and the actual pre-bend radius.

BRIEF DESCRIPTION OF THE DRAWINGS

FIGS. 3A and 3B are flowcharts for a method of operating a plate roll bending machine in accordance with the disclosure.

DETAILED DESCRIPTION

In one aspect, the disclosure relates to a hydraulic roll bending machine, which includes a frame and a plurality of hydraulic cylinders, the rotation and/or relative position of which can be controlled to achieve a desired shape in a plate to be bent. The machine includes a controller that is configured to calculate a required roll positioning scheme and roll activation sequence to produce a pre-bend or a bend operation on a plate. The controller includes information about the material to be processed, and also corrects for unknown factors affecting the material forming process, by performing a bending operation in two stages, a learning stage and a bending stage, each time an operation is carried out. More specifically, the controller operates to provide, in the first instance, a rough bend that approximates the final, desired dimension. The rough bend, which is performed in the learning stage, is carried out with a factor of safety or risk factor, which determines the extent of under-bending that the machine will calculate based on predefined parameters. This calculation may factor in the yield strength of the material variations in the thickness of the material, the finish of the material, as it may affect traction between the material and the rollers of the bending machine, the temperature of the material and other factors that may affect the behavior and spring-back of the material during and after bending.

After the initial or rough bend is carried out, feedback observed by the user and/or acquired by machine sensors relative to an actual bend radius of the machine versus the desired or commanded bend radius, is provided to the controller to indicate the resulting radius. The controller, based on the feedback information on the resulting radius of the bend, compares the actual dimension with a calculated dimension to determine a correction factor. The correction factor, which is indicative of the extent of variability of the particular plate being shaped to a nominal set of attributes for a plate of the type that is predefined in the controller, is applied to determine an appropriate bending configuration that will produce a plate shape of desired dimensions. The controller then applies the bending configuration, without the safety or risk factor, to cause the machine to produce a plate with a desired shape. The bending configuration may be understood as a correction factor of the material properties as observed during the initial bend, which correction factor is applied to the predefined properties of the material as they are stored in the machine controller. This two-step process in which the particular corrections that are required to counter any variability in the workpiece is repeated for every plate and for every bending operation.

Figure 1:
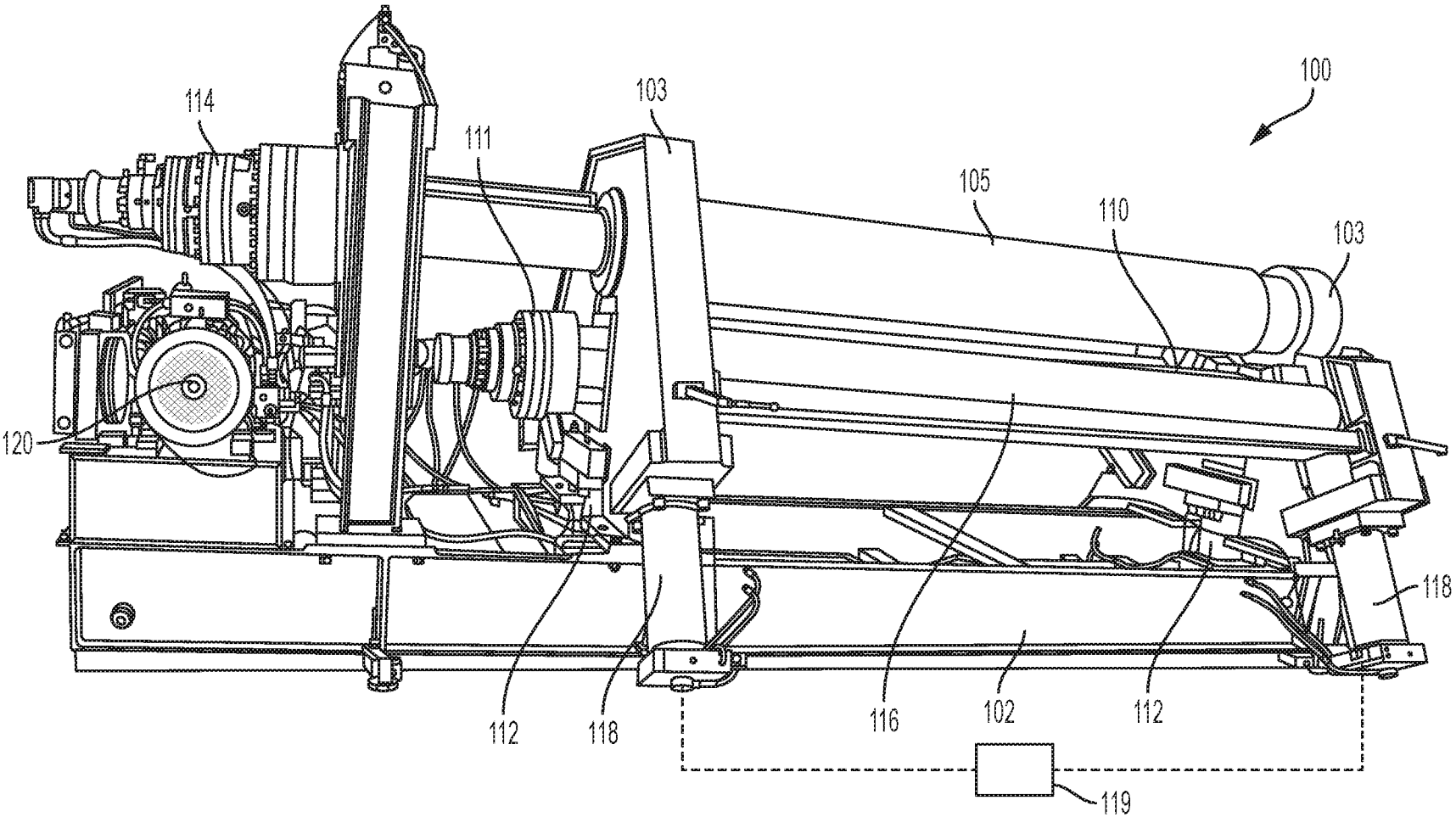
FIG. 1 is an overall view of a partially disassembled plate roll bending machine in accordance with the disclosure.

In the description that follows, a four-roll bending machine is shown and described but it should be appreciated that the controller and methods described herein are applicable to machines having different roll number configurations and/or machines of various sizes. A partially disassembled view of a roll bending machine 100 in accordance with the disclosure is shown in FIG. 1. The machine 100 includes a frame 102 that rotatably supports a top roll 105 mounted in a fixed horizontal position and supported by bearings 103 allowing rotational motion. The machine 100 further includes an adjustably mounted bottom roll 110 positioned by a cooperating pair of hydraulic cylinders 112. The bottom roll 110 is powered by a hydraulic motor 111. Top roll 105 is mounted in a horizontal position and associated at one end or the drive end with a hydraulic motor 114. At an opposite end, the top roll is supported by a bearing housing that is arranged to swing between open and closed positions to allow the loading and unloading of plates or other work pieces into the machine 100, as appropriate.

The machine 100 further includes front and rear bending rolls 116 (only one is visible in FIG. 1 but is representative of the arrangement in the rear of the machine). Each bending roll 116 is supported on the frame 102 by a pair of cooperating cylinders 118, one disposed on each end, which can independently raise and lower the ends of the bending roll to produce cylindrical, conical, and other shapes in plates bent by the machine 100 during operation. The various cylinder actuators 112, 118 and others may be fitted with pilot operated check valves to prevent lowering of the load should hydraulic pressure be unintentionally lost such as when a hydraulic hose breaks or there is an unexpected loss of hydraulic pressure in the system for another reason. Each cylinder may further be equipped with a position feedback sensor and pressure sensors providing information to a controller 119 indicative of the operating position and state of each cylinder. In the illustrated embodiment, an electric motor 120 powers a hydraulic pump (not shown) that provides pressurized fluid to operate the cylinder actuators 112 and 118, the hydraulic motors 111 and 114, and other hydraulic actuation devices in the machine 100 during operation.

Figure 2:
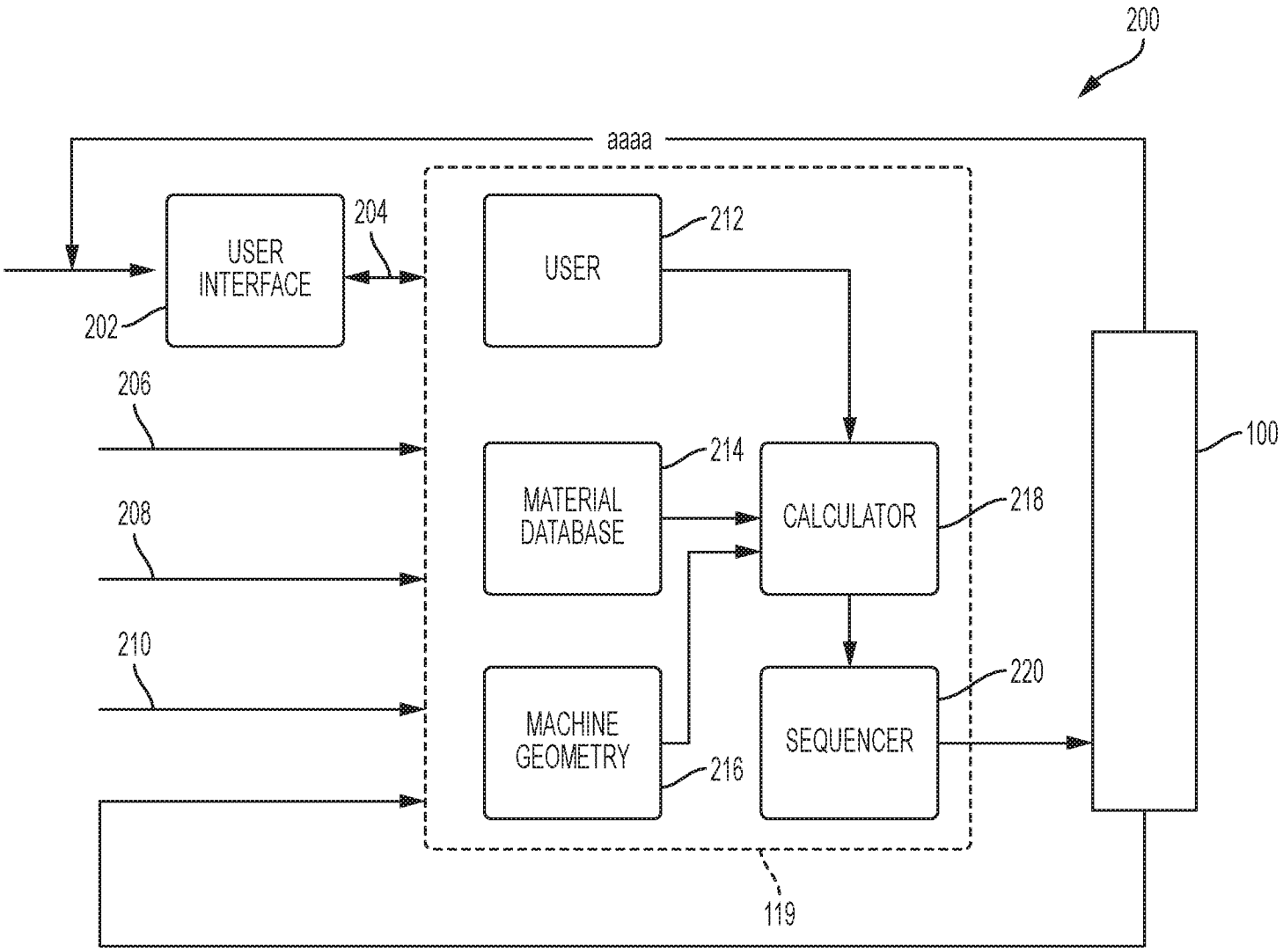
FIG. 2 is a block diagram of a controller associated with the machine shown in FIG. 1.

A block diagram of the controller 119 that is part of the machine 100 is shown in FIG. 2. The controller 119 and machine 100 can define a system 200 for bending plates. In the illustrated embodiment, the controller 119 is an electronic controller, for example, a programmable logic controller (PLC), which is operably associated with various sensors and actuators of the machine 100. The controller 119 may be a single controller or may include more than one controller disposed to control various functions and/or features of a machine. For example, a master controller, used to control the overall operation and function of the machine, may be cooperatively implemented with a motor or hydraulic system controller, used to control certain functions of the machine 100. In this embodiment, the term "controller" is meant to include one, two, or more controllers that may be associated with the machine 100 and that may cooperate in controlling various functions and operations of the machine 100 (FIG. 1). The functionality of the controller, while shown conceptually in FIG. 2 to include various discrete functions for illustrative purposes only, may be implemented in hardware and/or software without regard to the discrete functionality shown. Accordingly, various interfaces of the controller are described relative to components of the plate roll bending machine. Such interfaces are not intended to limit the type and number of components that are connected, nor the number of controllers that are described.

In the illustrated, exemplary embodiment, the controller 119 is associated with a user interface device 202, which can include any suitable haptic and/or electronic display that can be used to convey information to a user as well as be used by the user to provide information to the controller 119 via an input/output line 204. The controller 119 is also connected to other devices and configured to receive information from various sensors and other devices that is indicative of machine operating parameters. As shown, the controller 119 receives a position signal 206, which is indicative of the absolute or relative position of one or more of the various cylinders positioning the rolls in the machine, a speed signal 208, which is indicative of the rotational speed of the various rolls in the machine, a measurement signal 210, which is indicative of a measured dimension of a workpiece, and others. It should be appreciated that the various signals 204, 206, 208 and 210 are representative examples of various signals that pertain to the shaping operation carried out by the machine 100 and can be replaced by fewer or more such signals for a particular machine implementation.

The controller 119 further includes various internal modules or functions that carry out various processes. These include at least a user module 212, a material database 214, a machine geometry 216, a calculator 218 and a sequencer 220. Other modules may also be included. From a general aspect, the user module 212 includes information for authorized users of the device, and can allow the various users, which can access the controller using unique credentials, to control various levels of machine functionality and also set their desired machine environment in terms of language, units and others. The material database 214 includes predefined material information such as physical parameters, yield strength, harness and the like. The information in the material database may be populated based on known materials that will be used with the machine, which have predefined properties, and may also be populated by manually added materials by a user or other source of information. The machine geometry 216 includes precise information on the size and shape of the machine and its actuators to enable an exact application of force to deform work pieces in the machine.

The calculator 218 includes the mathematical relations used by the controller to calculate the initial force application and also the finishing force application described above onto the workpiece by the machine rollers and their position. The calculator may operate based on various physical equations or models. The sequencer 220 may include various structures that interface between the controller 119 and the various systems and actuators of the machine 100. During operation, the sequencer may provide the various commands and indications to the user that operate the machine in the contemplated fashion.

A flowchart for a method of operating a plate roll bending machine is shown in FIGS. 3A and 3B. In reference to FIGS. 3A and 3B, a series of steps are shown, as listed on the left column. A name of each operation is listed under the column with the heading "Step Description," and some additional detail for each step is shown under the column heading "Where Positions Come From," which indicates where the various machine parameters for each step are provided from. On the right of each step, a graphical representation of the position of each of four rollers of the machine, shown from a side perspective and labelled A, B, C and D, and also a rough shape of the plate being bent, are shown for illustration.

In accordance with the method, at Step 1, the machine assumes a starting configuration, which facilitates loading and positioning of the plate relative to the machine and rollers. In this configuration, the bottom roller C, which, for example, corresponds to the bottom roller 110 in FIG. 1, and the left bending roller A, are placed such that they contact the plate being inserted into the machine along a horizontal plane. The top roller D, which corresponds to the top roller 105 in FIG. 1, barely pinches or just touches the plate such that the plate is engaged between the top roller D and the bottom roller C. The right bending roller B is raised such that its horizontal diameter is aligned with a plane defined by the plate and the right bending roller B acts as a stop for the plate as it moves in a feeding direction, or towards the right of the illustration as shown. Positioning of the right bending roller B can be carried out automatically by the machine based on the sensed positions of the top and bottom rollers C and D. After the plate abuts the roller B, the machine establishes the height and also the axial position of the plate relative to the rollers, each of which is in contact with the plate in this configuration. The machine may record the vertical positions of all rollers in this position for use later as a reference.

At Step 2, hydraulic pressure is applied to raise the bottom roller C to clamp the plate between itself and the top roller D. The hydraulic pressure or force is calculated by machine controller so as not to locally deform the plate but to apply sufficient force to hold the plate between the top and bottom rollers securely and also determine the actual thickness of the plate, which may deviate from a nominal thickness by an acceptable degree but which may also incrementally increase the height of the plate material to be bent, which the machine will determine dynamically at a later Step.

At Step 3, the top and/or bottom rollers D and C are rotated to align a leading edge of the plate in the feeding direction, in a vertical direction, with the centerlines of the top and bottom rollers D and C. The distance by which the plate must travel in the reverse feeding direction is known based on the positions of the right bending roller B at Step 1 or 2. In the aligned position, the centerlines of the top and bottom rollers C and D are coplanar with the leading edge of the plate. At Step 4, the right bending roller B is lowered to be below the horizontal plane defined by the plate. The vertical position of the right bending roll B in this Step can be determined based on a preset machine parameter and also based on the position of the bottom roller C.

At Step 5, the rollers assume a pre-bending position, in which the left bending roller A is raised so as to create an arc in the plate as the plate is advanced in the feeding direction towards the right of the figures through the machine. The resulting radius of the arc imparted to the plate can be determined based on a percentage offset from a desired, final bend radius of the plate and also based on the physical characteristics of the material of the plate such as its modulus of elasticity, thickness, yield strength and others. In general, the position of the left bending roll A in this Step can also be based on a user input of a desired radius.

At Step 6, the rollers are rotated to advance the plate through the machine in the feeding direction such that a pre-bend is imparted on the plate. In this Step, the plate is advanced enough to reach the right bending roller B. When a sufficient length of the plate has been advanced, the left bending roller is lowered at Step 7 out of the way of the plate, for example, to a height that is vertically aligned with the bottom roller C, and the right bending roller B is raised at Step 8 to contact the plate and push it up, thus lowering the trailing portion of the plate to reestablish contact with the left bending roller A. In this position, the machine adjusts the heights of the rollers based on the parameters previously mentioned and also based on an expected spring-back of the plate material.

In one embodiment, the machine automatically calculates the resulting radius of the plate based on the position of the rollers C, D and B, when the right bending roller B contacts the plate. Alternatively, or additionally, the machine user may measure the resulting radius and input the measured value to the controller via the user interface. The machine controller will compare the commanded pre-bending radius with the automatically determined or measured resulting radius of the plate following the pre-bending operation and, based on the difference, determine any empirical adjustment that should be made to the material properties for the particular plate and for the particular bending operation. With the adjustments complete, the controller will store the revised material properties, or a correction to previously stored material properties, for use in subsequent steps of the bending operation.

At Step 9, the plate is advanced through the machine to achieve the desired radius until a hold point, which includes leaving a straight portion at the trailing edge portion of the plate. For performing Step 9, the machine controller uses the correction factor to the material properties, in conjunction with predefined material properties, for the particular plate, to calculate a roller position that will achieve a desired bend radius for the plate. At Step 10, the user supports the cylindrical portion of the plate to complete the bend past the hold point, which involves raising the right bending roller B even more at Step 11 so that the trailing portion of the plate is bent at a smaller radius and springs back to the desired radius. In Step 11 as well, the updated or corrected material properties are used for a calculation of the bending radius that is applied to the plate. At Step 12, the right bending roller B adjusts in position and the plate is rolled to its final shape. At Steps 13, 14 and 15, the rollers are moved to their unloading positions and the rolled plate is removed from the machine.

Figure 4:
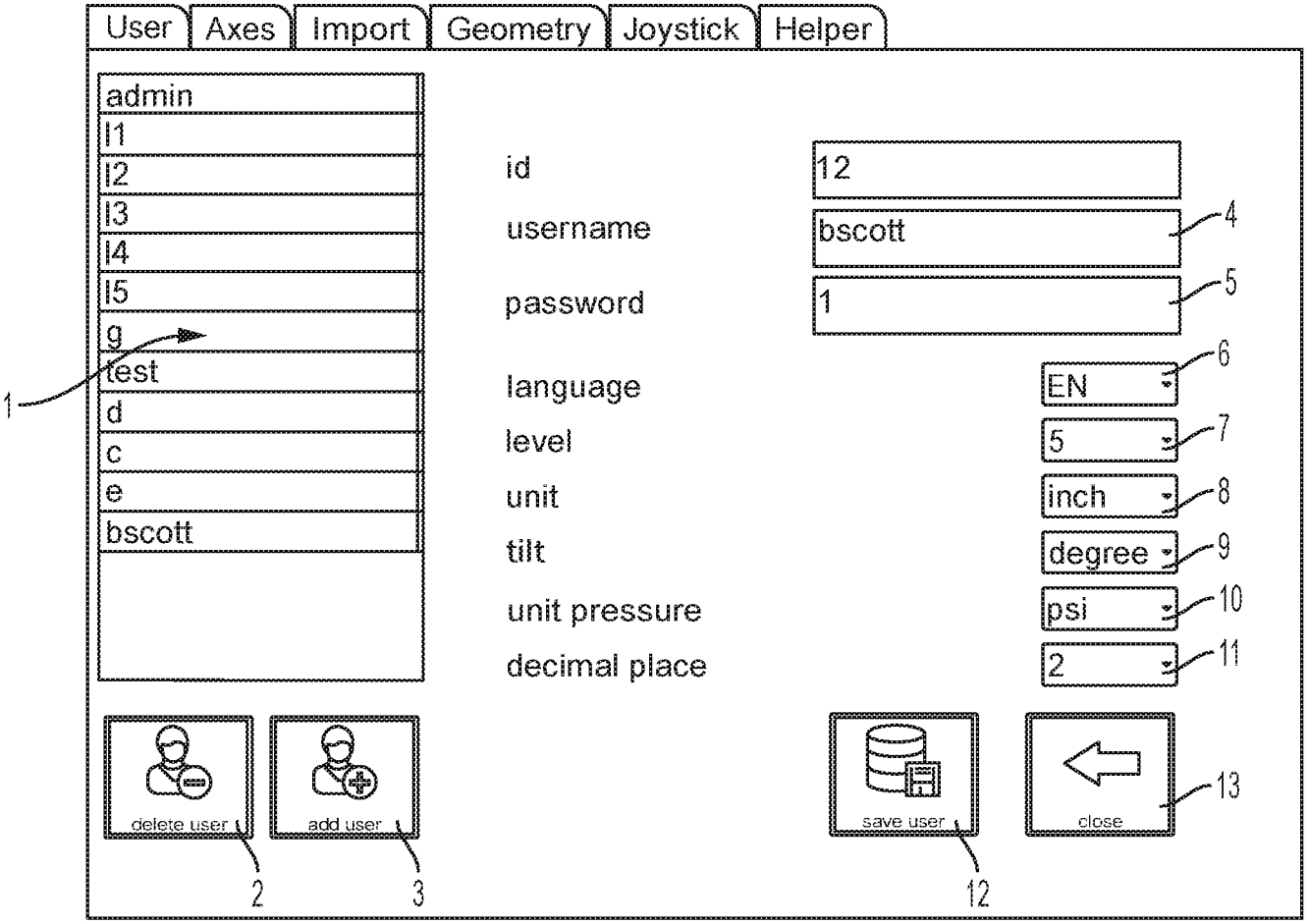
FIG. 4 is a sample user interface for entering a user in accordance with the disclosure.

Each of FIGS. 4-8 illustrates an exemplary user interface that the user may interact using the interface 202. In FIG. 4, the user interface is shown. The user interface operates to provide identification and preference information about a user or application to the machine controller, by inputting information in various fields or by selecting predefined options from dropdown menus. In the User interface shown in FIG. 1, in field 1 an existing user may be selected from a list. Button 2 allows deletion of a user and button 3 enables addition of a new user. In field 4, the username for the new user can be entered, and in field 5 the corresponding password for the new user can be entered. The language of the user can be set in dropdown menu 6. The user's level of authority, which determines various functions that can be unlocked or disabled can be set in field 7, and the units, and also the accuracy of the values, can be selected from dropdowns 8-11. The new user can be saved by clicking button 12, and the interface can return to a main application screed by button 13.

Figure 5:
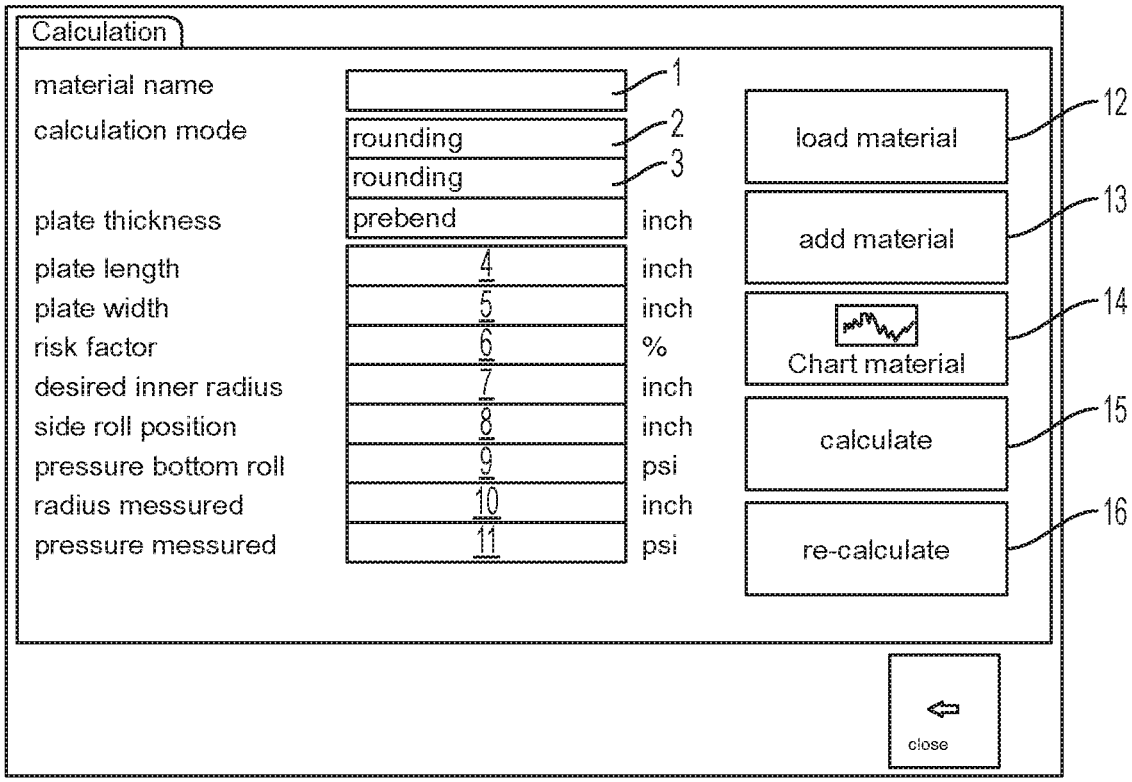
FIG. 5 is a sample user interface for performing a calculation in accordance with the disclosure.

A user interface that controls the material calculation of the machine controller, which can be used to calculate the pre-bending radius as previously described, is shown in FIG. 5. In reference to this figure, the name of a material can be input or loaded from a known material in field 1. The type of calculation that is carried out, for example, rounding or pre-bending is selected at field 2. Various plate dimensions are entered in fields 3 and 4 such as the plate length and width. The risk factor, which represents the percentage increase in the pre-bend radius versus the desired, final bend radius, is entered in field 6, and the desired bend radius is entered in field 7. Field 8 shows the calculated position for the bending roller that performs the bending after the calculation is complete, and a desired pressure of the bottom roll onto the plate can be entered in field 9, which will result after the calculation is complete. The actual radius measured can be entered in field 10, and the actual pressure in field 11, for the machine to determine the accuracy of the calculations to reduce variability in a subsequent operation.

Figure 6:
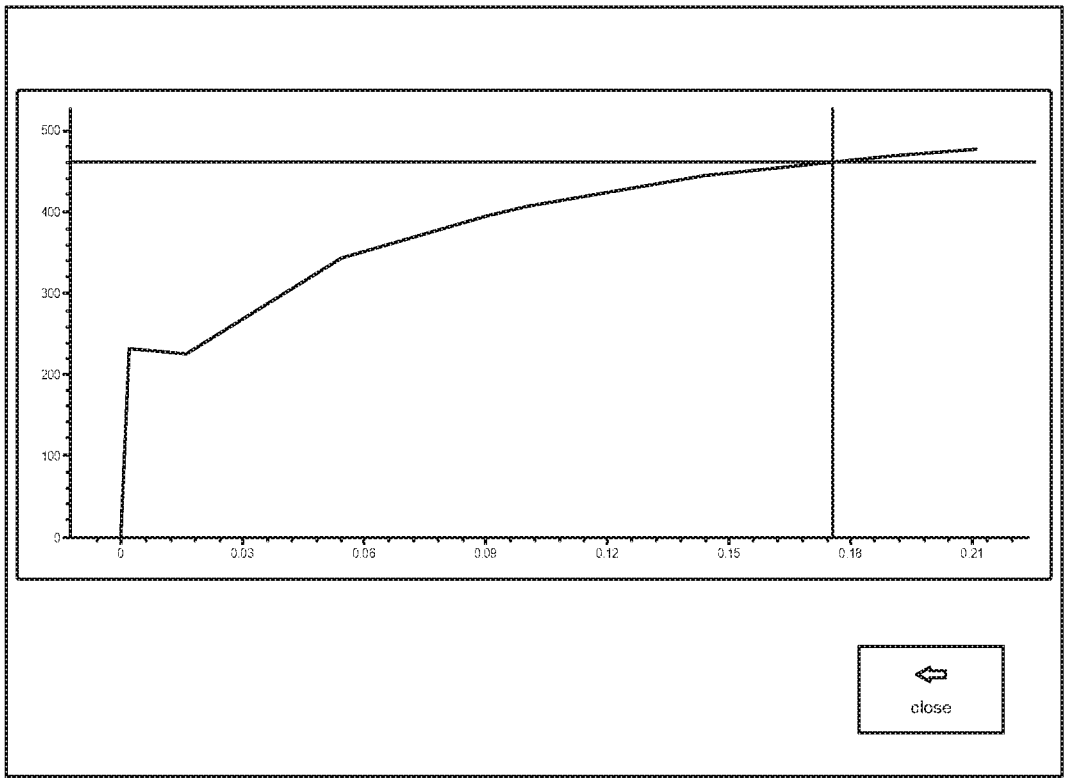
FIG. 6 is a sample stress/strain curve for a material in accordance with the disclosure.

Button 12 allows selection of a known material that is stored in the machine controller. Button 13 allows definition of a new material. Button 14 shows a graphical representation of the physical properties of a material, which is generated automatically by the machine controller. A sample chart is shown in FIG. 6. Button 15 begins a calculation, and button 16 permits a recalculation after a few iterations for the same material have been made to increase the accuracy of the calculations.

Figure 7:
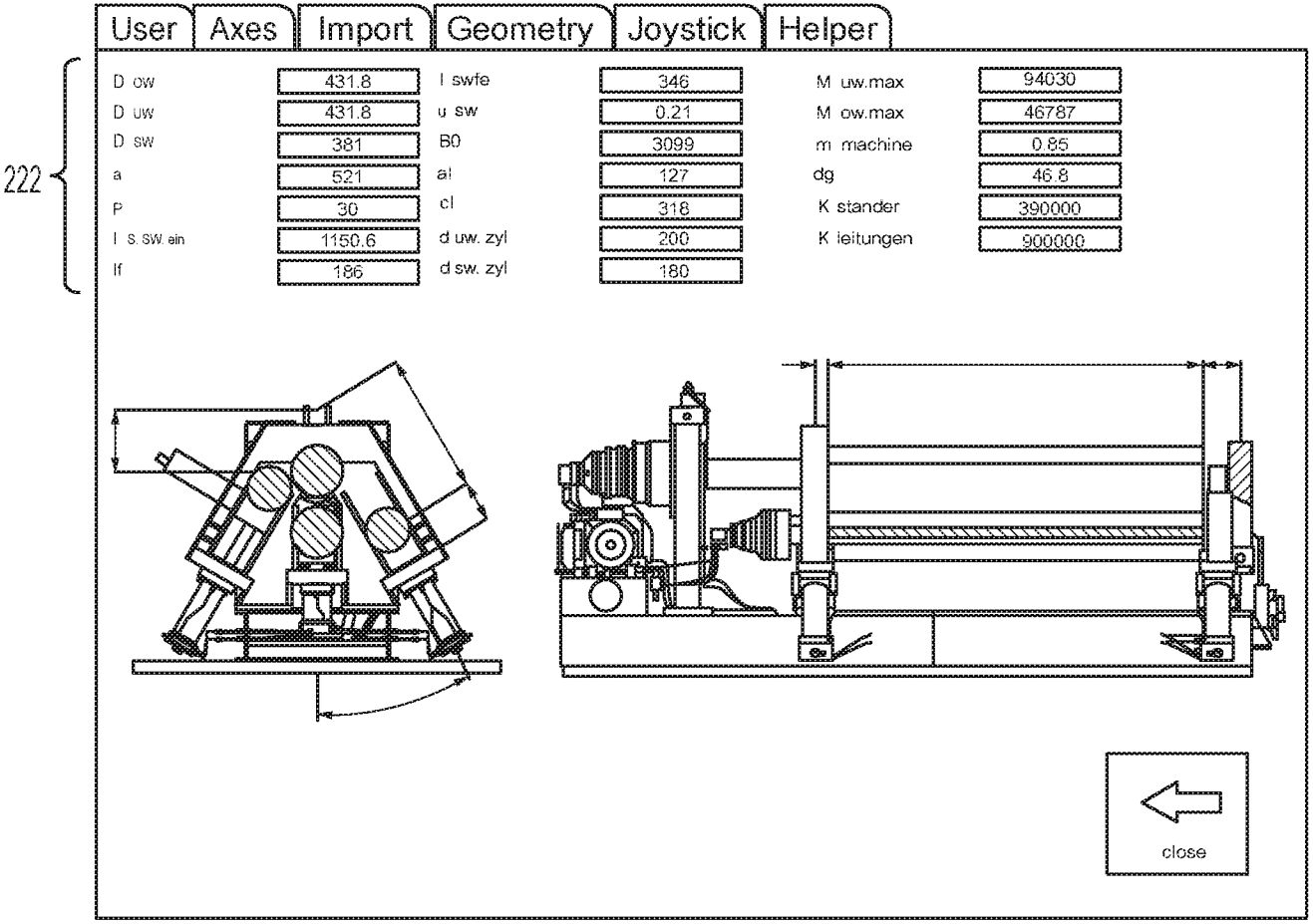
FIG. 7 is a sample machine geometry interface in accordance with the disclosure.

A user interface in which a user may input various dimensions 222 that are specific to the machine in which the machine controller operates is shown in FIG. 7. The various dimensions 222 which include, for example, the length of the machine, the size, stiffness and dimensions of the various rollers, the number of rollers, and other dimensions and parameters, can be used for the various calculations of the machine controller.

Figure 8:
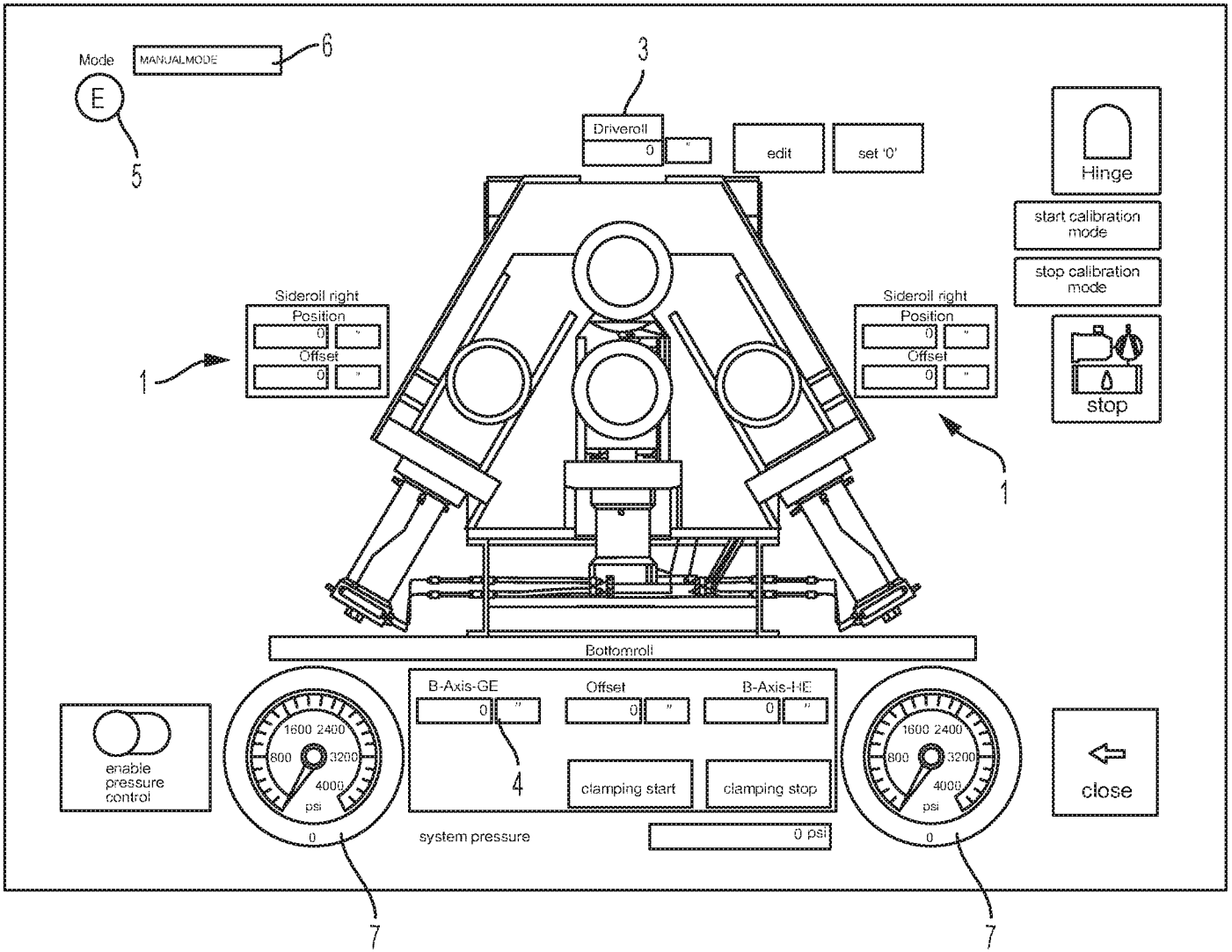
FIG. 8 is a sample machine dashboard in accordance with the disclosure.

A dash board showing various machine parameters during operation is shown in FIG. 8. In this display, machine parameters can be monitored by the user in real time during a bending operation. These parameters, which can be customized to suit a particular user or application, include a display 1 of the actual position of the left and right bending rollers, the position of the top or drive roller 3, the position of the bottom roller 4, an indicator of any error or warning states 5, the current machine mode 6, customizable dials showing hydraulic pressure 7, and others.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A hydraulic roll bending machine having a top roller, a bottom roller and at least one bending roller, the hydraulic roll bending machine comprising:

an electronic controller, the electronic controller including a material database stored in non-volatile memory, the material database including a material information library of material properties for a plurality of materials;

an actuator associated with the at least one bending roller, the actuator operating in response to a bending signal provided by the electronic controller;

a motor coupled with one of the top or bottom roller, the motor operating in response to a feed signal provided by the electronic controller;

a position sensor disposed to measure a position of the at least one bending roller relative to the machine, the position sensor configured to provide a position signal to the electronic controller;

wherein the electronic controller is programmed and configured to:

load a plate between the top roller and the bottom roller;

receive a user input indicative of a desired plate radius and a plate material from a machine user;

calculate a pre-bend radius for the plate based on the desired plate radius and information for the plate material from the material database;

provide a bending signal to the actuator to position the at least one bending roller relative to the top and bottom rollers based on the pre-bend radius;

provide a feed signal to advance a leading portion of the plate against the at least one bending roller;

determine an actual pre-bend radius of the leading portion of the plate;

calculate a set of revised material properties to update the material information library in the material database for the plate material based on a difference between the pre-bend radius and the actual pre-bend radius; and perform a bending operation on the plate based on the set of revised material properties.

2. The hydraulic roll bending machine of claim 1, wherein the electronic controller is further programmed and configured to calculate an updated bending signal based on the set of revised material properties in the material database and the desired plate radius.

3. The hydraulic roll bending machine of claim 2, wherein the electronic controller is further programmed and configured to cause the at least one bending roller to assume a new position based on the updated bending signal.

4. The hydraulic roll bending machine of claim 3, wherein the electronic controller is further programmed and configured to provide the feed signal to advance a remaining portion of the plate through the top and bottom rollers and against the at least one bending roller at its new position.

5. The hydraulic roll bending machine of claim 1, further comprising a second bending roller.

6. The hydraulic roll bending machine of claim 1, wherein the information in material database includes a material type, a material hardness, a material yield strength and a plate thickness for each of the plurality of materials, and wherein the user input is further indicative of a selection of one of the plurality of materials.

7. The hydraulic roll bending machine of claim 1, wherein the electronic controller is further programmed and configured to define a new material based on the set of revised material properties that is calculated, and store the new material as one of the plurality of materials in the material database.

8. A method for operating a hydraulic roll bending machine having a top roller, a bottom roller and at least one bending roller, the method comprising:

using an electronic controller associated with the hydraulic roll bending machine, the electronic controller including a material database stored in non-volatile memory, the material database including a material information library of material properties for a plurality of materials;

providing an actuator associated with the at least one bending roller, the actuator operating in response to a bending signal provided by the electronic controller;

providing a motor coupled with one of the top or bottom roller, the motor operating in response to a feed signal provided by the electronic controller;

providing a position sensor disposed to measure a position of the at least one bending roller relative to the machine, the position sensor configured to provide a position signal to the electronic controller;

loading a plate between the top roller and the bottom roller;

receiving a user input indicative of a desired plate radius and a plate material from a machine user into the electronic controller;

calculating a pre-bend radius for the plate based on the desired plate radius and information for the plate material from the material database using the electronic controller;

providing a bending signal to the actuator to position the at least one bending roller relative to the top and bottom rollers based on the pre-bend radius using the electronic controller;

providing a feed signal to advance a leading portion of the plate against the at least one bending roller using the electronic controller;

determining an actual pre-bend radius of the leading portion of the plate, providing the actual pre-bend radius to the electronic controller;

calculating a set of revised material properties to update the material information library in the material database for the plate material based on a difference between the pre-bend radius and the actual pre-bend radius using the electronic controller, and performing a bending operation of the plate based on the set of revised material properties.

9. The method of claim 8, further comprising calculating an updated bending signal based on the set of revised material properties in the material database and the desired plate radius using the electronic controller.

10. The method of claim 9, further comprising causing the at least one bending roller to assume a new position based on the updated bending signal using the electronic controller.

11. The method of claim 10, further comprising providing the feed signal to advance a remaining portion of the plate through the top and bottom rollers and against the at least one bending roller at its new position using the electronic controller.

12. The method of claim 8, further comprising using a second bending roller to position and pre-bend the plate.

13. The method of claim 8, wherein the information in the material database includes a material type, a material hardness, a material yield strength and a plate thickness for each of the plurality of materials, and wherein the user input is further indicative of a selection of one of the plurality of materials.

14. The method of claim 8, further comprising defining a new material based on the set of revised material properties that is calculated, and storing the new material as one of the plurality of materials in the material database.

15. An electronic controller associated with a hydraulic roll bending machine, the hydraulic roll bending machine having a top roller, a bottom roller, at least one bending roller, an actuator associated with the at least one bending roller, a motor coupled with one of the top or bottom roller, and a position sensor disposed to measure a position of the at least one bending roller relative to the machine, the electronic controller comprising:

a material database stored in non-volatile memory, the material database including a material information library of material properties for a plurality of materials;

a connection to the actuator, which actuator configured to operate in response to a bending signal provided by the electronic controller;

a connection to the motor, the motor configured to operate in response to a feed signal provided by the electronic controller;

a connection to the position sensor, the position sensor configured to provide a position signal to the electronic controller;

wherein the electronic controller is programmed and configured to:

load a plate between the top roller and the bottom roller;

receive a user input indicative of a desired plate radius and a plate material from a machine user;

calculate a pre-bend radius for the plate based on the desired plate radius and information for the plate material from the material database;

provide a bending signal to the actuator to position the at least one bending roller relative to the top and bottom rollers based on the pre-bend radius;

provide a feed signal to advance a leading portion of the plate against the at least one bending roller;

determine an actual pre-bend radius of the leading portion of the plate;

calculate a set of revised material properties to update the material information library in the material database for the plate material based on a difference between the pre-bend radius and the actual pre-bend radius; and perform a bending operation on the plate based on the set of revised material properties.

16. The electronic controller of claim 15, wherein the electronic controller is further programmed and configured to calculate an updated bending signal based on the set of revised material properties in the material database and the desired plate radius.

17. The electronic controller of claim 16, wherein the electronic controller is further programmed and configured to cause the at least one bending roller to assume a new position based on the updated bending signal.

18. The electronic controller of claim 17, wherein the electronic controller is further programmed and configured to provide the feed signal to advance a remaining portion of the plate through the top and bottom rollers and against the at least one bending roller at its new position.

19. The electronic controller of claim 15, wherein the information in the material database includes a material type, a material hardness, a material yield strength and a plate thickness for each of the plurality of materials, and wherein the user input is further indicative of a selection of one of the plurality of materials.

20. The electronic controller of claim 15, wherein the electronic controller is further programmed and configured to define a new material based on the set of revised material properties that is calculated, and store the new material as one of the plurality of materials in the material database.

* * * * *